United States Patent [19]

Nishida

[11] Patent Number: 4,631,032

[45] Date of Patent: Dec. 23, 1986

[54] ENGINE EXHAUST APPARATUS FOR WATER-JET PROPULSION BOAT

[75] Inventor: Hiroshi Nishida, Miki, Japan

[73] Assignee: Kawasaki Jukogyo Kabushiki Kaisha, Kobe, Japan

[21] Appl. No.: 693,097

[22] Filed: Jan. 22, 1985

[30] Foreign Application Priority Data

Jan. 27, 1984 [JP] Japan ..... 59-14123

[51] Int. Cl.[4] ..... B63H 11/103

[52] U.S. Cl. ..... 440/47; 440/83; 440/89; 416/93 A

[58] Field of Search ..... 440/38, 46, 47, 83, 440/89; 416/93 R, 93 A, 93 M

[56] References Cited

U.S. PATENT DOCUMENTS

| | | | |
|---|---|---|---|
| 888,390 | 5/1908 | Dalen | 440/89 |
| 2,213,612 | 9/1940 | Ronning | 416/93 M |
| 3,099,241 | 7/1963 | MacFarlin | 440/89 |
| 3,763,817 | 10/1973 | Francis | 440/47 |
| 3,943,876 | 3/1976 | Kiekhaefer | 440/47 |
| 4,436,514 | 3/1984 | Takahashi et al. | 440/89 |

FOREIGN PATENT DOCUMENTS

| | | | |
|---|---|---|---|
| 776656 | 1/1935 | France | 416/93 M |
| 124583 | 4/1949 | Sweden | 416/93A |

*Primary Examiner*—Galen Barefoot
*Assistant Examiner*—Stephen P. Avila
*Attorney, Agent, or Firm*—Leydig, Voit & Mayer

[57] ABSTRACT

An exhaust apparatus for a water jet propulsion boat having an engine exhaust passage provided inside an impeller shaft. The exhaust passage opens into the water jet at a position rearward of an impeller. Thus, the length of an engine exhaust pipe can be reduced, and it is possible to reduce the space required for installation of the exhaust apparatus. Since the engine exhaust gas is discharged into the water jet at a position to the rear of the impeller, no cavitation occurs at the impeller portion. Further, it is possible to utilize the engine exhaust gas as a gas layer constituting a pneumatic bearing for supporting the impeller shaft.

6 Claims, 7 Drawing Figures

ENGINE EXHAUST APPARATUS FOR WATER-JET PROPULSION BOAT

BACKGROUND OF THE INVENTION

1. Field of the Invention

The present invention relates to an engine exhaust apparatus for a water-jet propulsion boat in which a water-jet pump casing is provided within a hull, and an impeller in the pump casing is secured to an impeller shaft, which is in turn connected to an engine output shaft in interlocking relation to the output shaft.

2. Description of the Prior Art

A conventional engine exhaust apparatus for a water-jet propulsion boat has until now been arranged such that an exhaust pipe itself, which is connected to an exhaust port of an engine, it extended such as to open into the water or air. In the exhaust apparatus of the type described above, as the length of the exhaust pipe increases, a correspondingly wide space for disposing the exhaust pipe is required.

Further, in the case where the exhaust gas is discharged into the air, the exhaust noise creates a problem. In the case of discharging the extent gas into the water also, various problems arise if the exhaust pipe opens at an undesirable position. For instance, if the exhaust pipe opens forwardly of the impeller, cavitation is unfavorably caused at the impeller portion by the undesirable suction of the exhaust gas. Even at a position rearward of the impeller, if the exhaust pipe opens downwardly of the pump casing, the back pressure in relation to the exhaust gas is inconveniently increased.

SUMMARY OF THE INVENTION

It is an object of the present invention to provide an engine exhaust apparatus for a water-jet propulsion boat in which the inside of an impeller shaft is utilized as an exhaust passage, thereby allowing a decrease in the length of the exhaust pipe connected to the engine as well as a reduction in the installation space taken up by the exhaust apparatus.

It is another object of the present invention to provide an engine exhaust apparatus for a water-jet propulsion boat which allows the engine exhaust gas to be readily discharged into the water jet at an exhaust position where no cavitation is caused in the water jet by the engine exhaust gas, namely, at a position to the rear of the impeller.

To these ends, the exhaust apparatus according to the invention features the following:

(1) The impeller shaft is made hollow so that an exhaust passage is defined within its body.

(2) The exhaust passage is communicated with the exhaust port of the engine through the exhaust pipe.

(3) An exhaust outlet which opens into the water jet rearwardly of an impeller is formed in the impeller shaft and is communicated with the exhaust passage.

DESCRIPTION OF THE PREFERRED EMBODIMENTS

Figure 1:
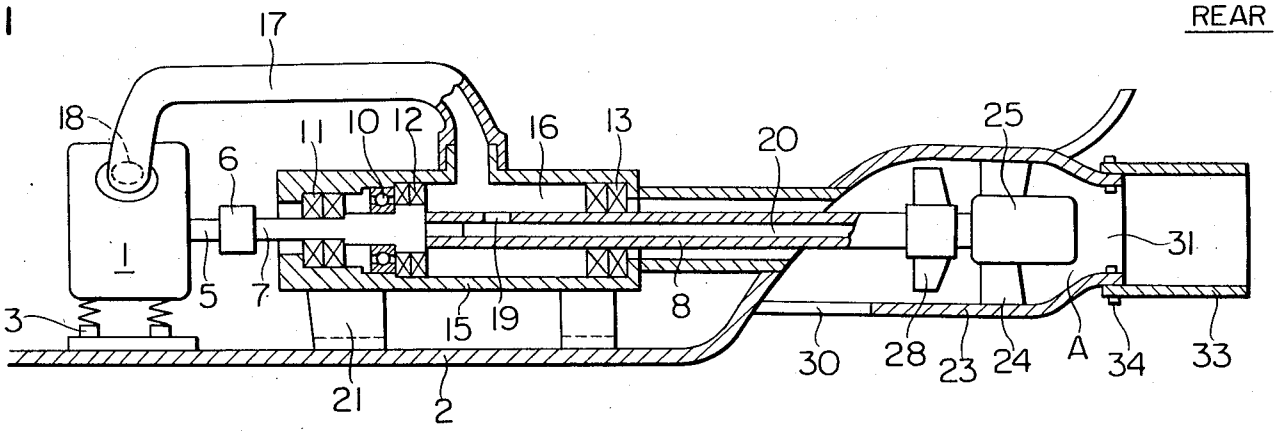
FIG. 1 is a vertical sectional view through the length of a small-sized boat to which the present invention is applied.

Referring first to FIG. 1, an engine 1 is supported by a hull 2 through a vibration damper 3 and has an output shaft 5 projecting rearwardly. The output shaft 5 is connected with a solid transmission shaft 7 through a coupling 6. A hollow pipe-like impeller shaft 8 is welded to the rear end portion of the transmission shaft 7. Both the transmission shaft 7 and the impeller shaft 8 are rotatably attached to the inner peripheral surface of a bearing housing 15 through a bearing 10, seals 11, 12, 13 and so forth.

In the housing 15 is defined an annular exhaust passage 16 which is hermetically sealed with the seals 12, 13. The annular passage 16 is communicated with an exhaust port 18 of the engine 1 through an exhaust pipe 17. A plurality of exhaust communicating bores 19 are formed in the portion of the impeller shaft 8 within the housing 15. Through the bores 19, an exhaust passage 20 formed inside the impeller shaft 8 is communicated with the annular passage 16. The reference numeral 21 denotes a bracket which supports the housing 15 on the hull 2.

A water-jet pump casing 23 is provided at the rear end portion of the hull 2. A casing boss 25 for supporting the impeller shaft 8 is secured inside the casing 23 through a plurality of water-jet guide blades 24. The impeller shaft 8 is inserted into the casing 23 from its front side. The rear end portion of the impeller shaft 8 is rotatably supported by the casing boss 25. An impeller 28 having a plurality of blades is disposed in a portion inside the casing 23 forwardly of the casing boss 25. The impeller 28 is secured to the impeller shaft 8. Further, a water suction port 30 is formed in the lower front end portion of the pump casing 23 such as to open downwardly. At the rear end portion of the pump casing 23, a water-jet outlet 31 is formed, and further, a steering nozzle 33 is mounted through a vertical pin 34 such as to be pivotal in both rightward and leftward directions.

Figure 2:
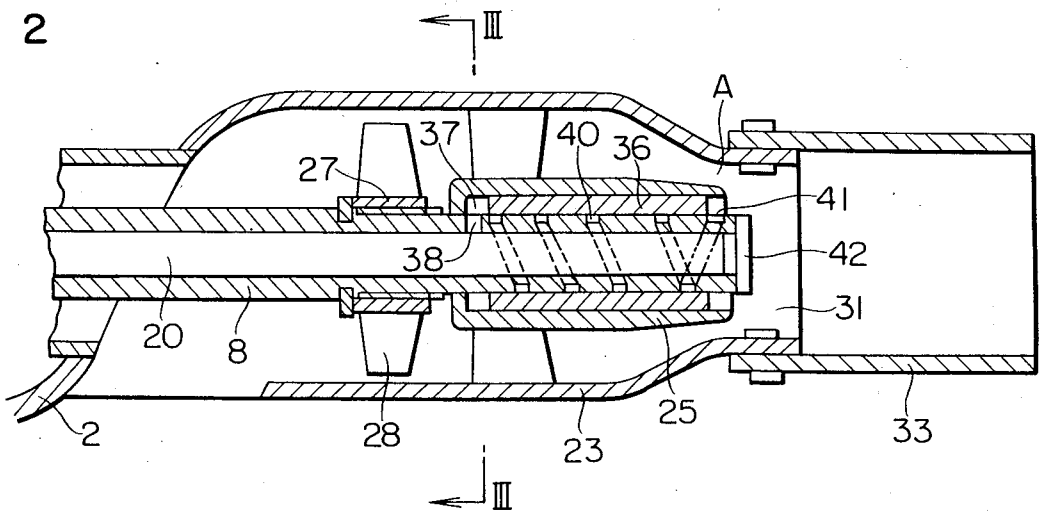
FIG. 2 is an enlarged view of an essential part of the boat shown in FIG. 1.

Referring next to FIG. 2 which is an enlarged view of an essential part of what is shown in FIG. 1, the impeller 28 has its boss portion 27 screwed with the threaded portion formed on the outer periphery of the impeller shaft 8, and the impeller shaft 8 is rotatably supported by the boss 25 through a bushing 36.

At the front end portion inside the boss 25 is formed an annular chamber 37 along the outer peripheral surface of the impeller shaft 8. The annular chamber 37 is communicated with the inside of the impeller shaft 8 through a plurality of communicating bores 38 and is further communicated with a spiral groove 40. The spiral groove 40 is formed on the outer peripheral surface of the impeller shaft 8 such as to extend from the position on the surface of the impeller shaft 8 which opposes the annular chamber 37 to the rear end of the impeller shaft 8. The spiral groove 40 has an exhaust outlet 41 at the rear end portion of the impeller shaft 8. The outlet 41 opens at a position inside the pump casing 23 where the water pressure has been lowered such as, for example, a position inside the pump casing 23 which is rearward of a throttle portion A. At the throttle portion A, the water pressure is converted into a flow velocity and therefore is lowered. The reference numeral 42 denotes a cover which closes the rear end of the impeller shaft 8.

Figure 3:
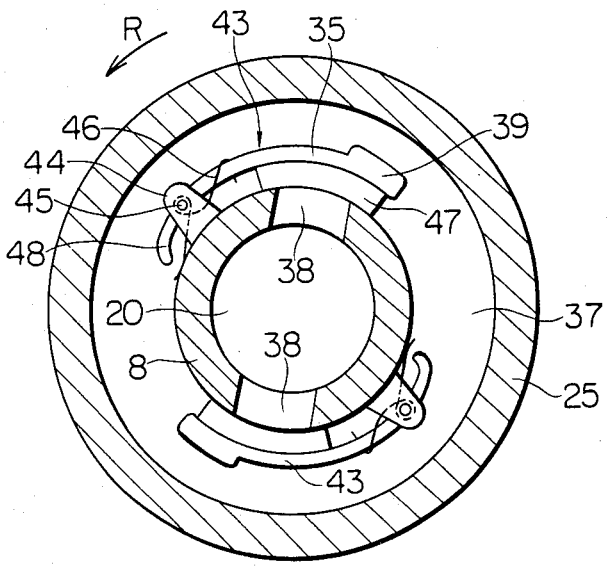
FIGS. 3 and 4 are enlarged sectional views taken along the line III—III of FIG. 2 which respectively show the essential part in a state wherein valves are closed and a state wherein the valves are open.

The annular chamber 37 in the casing boss 25 is, as shown in FIG. 3, provided with centrifugally operated check valves 43 for preventing any back-flow. Each check valve 43 has a circular arm 35. The forward end portion (in terms of the direction of rotation R of the impeller shaft 8) of the arm 35 is pivotally supported by a bracket 44 on the impeller shaft 8 through a pin 45 which is disposed parallel to the impeller shaft 8. The arm 35 extends as far as the outer peripheral portion of the impeller shaft 8 at which point one of the communicating bores 38 is located. Moreover, a weighted portion 39 is integrally formed at the rearward end portion (in terms of the direction of rotation R of the impeller shaft 8) of the arm 35. A gasket 47 is bonded to the inner peripheral surface of the check valve 43. Further, the arm 35 is biased toward the axial center of the impeller shaft 8 by the resilient force of a coiled spring 46, whereby the bore 38 is closed with the gasket 47. The reference numeral 48 denotes a stopper which is formed at the forward end of the arm 35. The stopper 48 provides a maximum limit for the opening of the check valve 43 by abutting against the outer peripheral surface of the impeller shaft 8. More specifically, when the valve 43 is open as shown in FIG. 4, the stopper 48 abuts against the outer peripheral surface of the impeller shaft 8 such as to prevent the weighted portion 39 from interfering with the inner peripheral surface of the boss 25.

The following is a description of the operation of the above-described embodiment.

As the engine 1 shown in FIG. 1 is driven, the impeller 28 is rotated through the output shaft 5, the transmission shaft 7 and the impeller shaft 8, whereby seawater (or fresh water) is sucked in from the suction port 30 and is pressurized. After being accelerated (reduced in pressure) at the throttle portion A, the water is jetted out rearwardly from the water-jet outlet 31.

Figure 4:
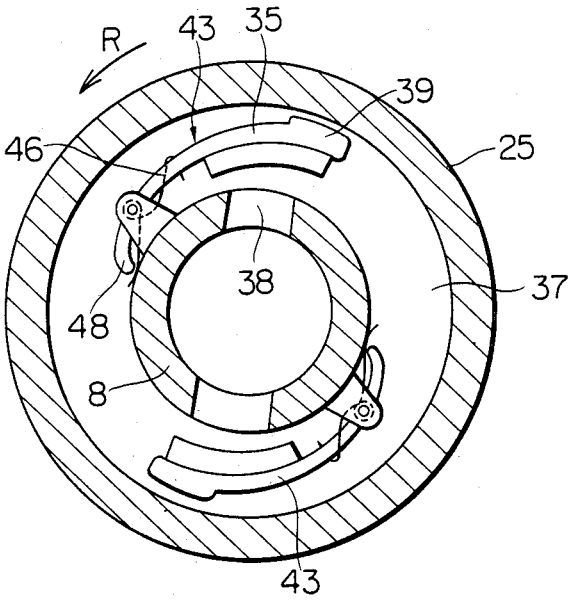

As the impeller shaft 8 is rotated, each check valve 43 shown in FIG. 3 is outwardly opened by means of centrifugal force acting against the spring 46, thus providing a communication between the inside of the impeller shaft 8 and the annular chamber 37 as shown in FIG. 4.

The exhaust gas discharged from the exhaust port 18 of the engine 1 shown in FIG. 1 passes through the exhaust pipe 17, the annular passage 16 inside the bearing housing 15 and the bores 19 and flows into the exhaust gas passage 20 inside the impeller shaft 8. The exhaust gas flowing into the exhaust passage 20 flows rearwardly and enters the annular chamber 37 through the communicating bores 38 shown in FIG. 2. From the annular chamber 37, the exhaust gas is supplied into the spiral groove 40. The exhaust gas then proceeds while spiralling along the outer periphery of the impeller shaft 8 to reach the outlet 41 at the rear end of the impeller shaft 8 and is then discharged into the water jet having been reduced in pressure.

While passing through the spiral groove 40, the exhaust gas forcedly enters also the area between the inner peripheral surface of the bushing 36 and the outer peripheral surface of the impeller shaft 8 to form an exhaust gas layer in the shape of a thin film. This exhaust gas layer serves as a pneumatic bearing which enables a smooth rotation of the impeller shaft 8 and a reduction in wearing of the impeller shaft 8 and the bushing 36.

Further, since the outlet 41 opens into a portion inside the pump casing 23 where the water pressure is relatively low, the back pressure is sufficiently low to allow the exhaust gas to be smoothly discharged from the outlet 41.

When the engine 1 (see FIG. 1) is at rest, the check valves 43 are closed in the manner shown in FIG. 3, whereby the seawater (or fresh water) is prevented from entering the inside of the impeller shaft 8.

Figure 5:
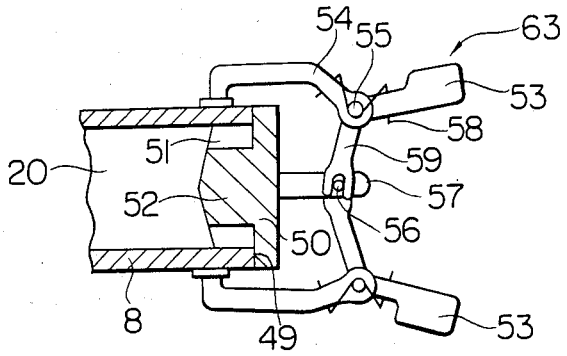
FIG. 5 is a vertical sectional view of an essential part of another embodiment of the invention.

FIG. 5 shows a second embodiment of the invention, in which the impeller shaft 8 has its rear end opened such as to define an exhaust outlet 49, and a centrifugally operated stop valve 63 is provided at the outlet 49. The stop valve 63 includes a valve body 50 having a smaller-diameter portion 52, which is slidably fitted to the inner peripheral surface of the impeller shaft 8 in the axial direction thereof. The valve body 50 further has a plurality of outlet grooves 51 which are parallel to the axis of the impeller shaft 8. As a mechanism for opening and closing the valve body 50, for example, a pair of flyweights 53 are provided. Each of the flyweights 53 is pivotally supported by a stay 54 through a pin 55. Further, each flyweight 53 is integrally formed with an arm 59 which extends as far as a projection 57 projecting rearwardly from the valve body 50. The distal end portion of the arm 59 is formed with a forked shape. On the other hand, the projection 57 which projects rearwardly from the valve body 50 has a pin 56 secured thereto. Thus, each arm 59 is engaged with the pin 56. Each weight 53 is biased toward the axial center of the impeller shaft 8 by means of the resilient force of the corresponding coiled spring 58, whereby the valve body 50 is placed at its valve closing position. The exhaust passage 20 inside the impeller shaft 8 is communicated with the same path as that in the case of the first embodiment shown in FIG. 1, that is, the exhaust passage 20 is communicated with the exhaust port 18 of the engine 1 through the annular passage 16 inside the bearing housing 15 and the exhaust pipe 17.

The following is a description of the operation of the second embodiment.

Figure 6:
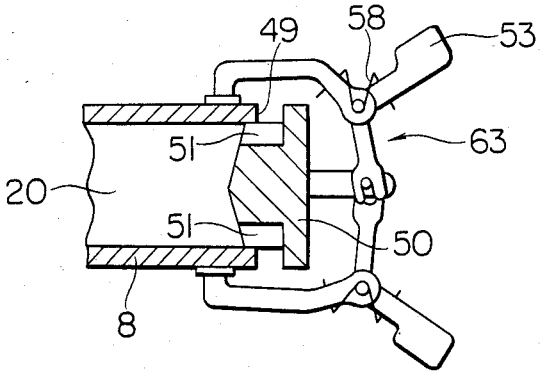
FIG. 6 is a vertical sectional view of the same part shown in FIG. 5, showing the essential part in a state wherein a valve is open.

As the impeller shaft 8 shown in FIG. 5 is rotated, the flyweights 53 are expanded radially outward by means of centrifugal force. Thereupon, the valve body 50 is moved rearwardly through the combined action of the arms 59, the pin 56 and the projection 57, whereby the exhaust outlet 49 is opened as shown in FIG. 6. The exhaust gas, which is supplied from the engine exhaust port 18 shown in FIG. 1 into the exhaust passage 20 shown in FIG. 6 through the exhaust pipe 17 and so forth, is discharged into the water jet through the grooves 51 and the outlet 49 defined between the valve body 50 and the rear end surface of the impeller shaft 8.

When the rotation of the impeller shaft 8 stops as the result of suspension of running of the engine 1, the valve body 50 is moved by the resilient force of the springs 58 such as to close the exhaust outlet 49 as shown in FIG. 5, thereby preventing intrusion of the seawater (or fresh water) into the inside of the impeller shaft 8.

Figure 7:
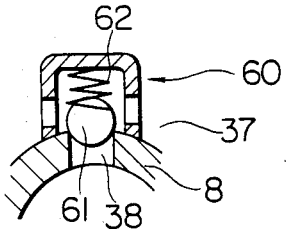
FIG. 7 shows a modification of a check valve, which corresponds to a sectional view taken along the line III—III of FIG. 2.

Further, the present invention may be carried out in a variety of forms:

(1) As the check valve for opening and closing the communicating bore 33 such as that shown in FIG. 3, it is possible to utilize a centrifugal ball type check valve 60 such as that shown in FIG. 7. More specifically, while the engine 1 is running, a ball 61 is moved outwardly against a spring 62 by means of centrifugal force, thus providing a communication between the exhaust passage 20 and the annular chamber 37.

(2) The exhaust outlet in the impeller shaft may be formed such as to open at a position where the water pressure is relatively high.

(3) The centrifugally operated valves which are respectively shown in FIGS. 3 and 5 are not necessarily exclusive and various types of valve, such as electrically or hydraulically operated valves, may be employed.

However it is necessary to arrange the valve employed such that it is open while the engine 1 is running and is closed when the running of the engine 1 is suspended.

Thus, the present invention offers the following advantageous effects:

(1) The impeller shaft is made hollow so that the exhaust passage is defined within its body, and the exhaust passage is communicated with the engine exhaust port through the exhaust pipe, whereby the inside of the impeller shaft is utilized as an exhaust passage. Accordingly, the length of the exhaust pipe can be reduced by a large margin, so that it is possible to lower the costs of parts required for the exhaust apparatus. Moreover, it is possible to reduce the space required for installation of the exhaust apparatus. Thus, the invention is most suitable for a small-sized boat.

(2) Since the exhaust gas is discharged into the water jet at a position rearward of the impeller, there is no fear that cavitation may occur at the impeller portion and the back pressure in relation to the exhaust gas may increase. In other words, there is no possibility that the discharge of exhaust gas may have adverse effects on the rotation of the impeller and the performance of the engine.

(3) Since the inside of the impeller shaft is utilized as an exhaust passage, there is no need for a special piping for the purpose of providing a communication between the outside and inside of the pump casing so as to discharge the exhaust gas into the water jet at a position rearward of the impeller. Accordingly, it is advantageously possible to simplify the structure of the exhaust apparatus.

What is claimed is:

1. A propulsion apparatus for a water jet propulsion boat having a hull, a water jet pump casing with said hull, and an impeller in said pump casing driven by an engine in said hull, said propulsion apparatus comprising:

means in said pump casing defining a converging passage for increasing water flow velocity and having a smaller diameter section within which water jet pressure is reduced due to the increase in velocity:

a hollow impeller shaft defining an exhaust passage within an inner wall of said impeller shaft, said exhaust passage being communicated at a forward end portion of said impeller shaft with an exhaust port of said engine;

means connecting said impeller to said impeller shaft:

an exhaust outlet communicating with said exhaust passage formed in said impeller shaft and located rearward of said impeller and within said smaller diameter section of said pump casing to discharge exhaust into a water jet portion of higher velocity and reduced pressure within said section;

a casing boss rotatably supporting the rear end portion of said impeller shaft;

a bushing disposed between said impeller shaft and said casing boss;

an annular chamber defined by an outer peripheral surface of said impeller shaft and said casing boss;

a plurality of communicating bores formed in said impeller shaft such as to extend in the radial direction thereof, said communicating bores providing a communication between said exhaust passage and said annular chamber; and a spiral groove formed on the outer peripheral surface of said impeller shaft within a region in which it is supported by said bushing, said spiral groove providing a communication between said annular chamber and said exhaust outlet.

2. A propulsion apparatus according to claim 1 further comprising:

a plurality of check valves disposed inside said annular chamber and adapted to adapted to shut off the communication between said annular chamber and said communicating bores when rotation of said impeller is suspended.

3. A propulsion apparatus according to claim 2, wherein each of said check valves includes:

a ball which is disposed inside said annular chamber and is biased toward an axial center of said impeller shaft by a spring for closing a corresponding one of said communicating bores.

4. A propulsion apparatus for a water jet propulsion boat having a hull, a water jet pump casing with said hull, and an impeller in said pump casing driven by an engine in said hull, said propulsion apparatus comprising:

means in said pump casing defining a converging passage for increasing water flow velocity and having a smaller diameter section within which water jet pressure is reduced due to the increase in velocity;

a hollow impeller shaft defining an exhaust passage within an inner wall of said impeller shaft, said exhaust passage being communicated at a forward end portion of said impeller shaft with an exhaust port of said engine;

means connecting said impeller to said impeller shaft:

an exhaust outlet communicating with said exhaust passage formed in said impeller shaft and located rearward of said impeller and within said smaller diameter section of said pump casing to discharge exhaust into a water jet portion of higher velocity and reduced pressure within said section, said exhaust outlet communicating at a rear end surface of said impeller shaft, and a centrifugally operated stop valve for said outlet operated by said impeller shaft.

5. A propulsion apparatus for a water jet propulsion boat having a hull, a water jet pump casing within said hull, and an impeller in said pump casing driven by an engine in said hull, said propulsion apparatus comprising:

a hollow impeller shaft defining an exhaust passage within an inner wall of said impeller shaft, said exhaust passage being communicated at a forward end portion of said impeller shaft with an exhaust port of said engine;

means connecting said impeller to an intermediate portion of said impeller shaft;

an exhaust outlet formed at a rear end portion of said impeller shaft such as to open into a water jet flowing through said casing at a position rearward of said impeller, said exhaust outlet being communicated with said exhaust passage;

a casing boss rotatably supporting said rear end portion of said impeller shaft;

a bushing disposed between said impeller shaft and said casing boss;

an annular chamber defined between an outer peripheral surface of said impeller shaft and said casing boss;

a plurality of communicating bores formed in said impeller shaft such as to extend in the radial direction thereof, said communicating bores providing communication between said exhaust passage and said annular chamber;

means forming a spiral groove on the outer peripherial surface of said impeller shaft within a region in which it is supported by said bushing, said spiral groove providing communication between said annular chamber and said exhaust outlet; and a plurality of check valves disposed inside said annular chamber capable of shutting off the communication between said annular chamber and said communicating bores when rotation of said impeller is stopped;

said check valves including:

a bracket secured to the outer peripheral surface of said impeller shaft;

a circular arm;

a pin rotatably connecting to said bracket at a forward end portion of said circular arm in terms of a direction of rotation of said impeller shaft;

a stopper formed at the forward end of said circular arm in terms of the direction of rotation of said impeller shaft such as to be capable of abutting against the outer peripheral surface of said impeller shaft;

a weighted portion provided at a rearward end portion of said circular arm in terms of the direction of rotation of said impeller shaft;

a gasket provided on an inner peripheral surface of the rearward end portion of said circular arm in terms of the direction of rotation of said impeller shaft such as to be capable of closing a corresponding one of said communicating bores; and a spring disposed such as to bias toward an axial center of said impeller shaft the rearward end portion of said circular arm in terms of the direction of rotation of said impeller shaft.

6. A propulsion apparatus for a water jet propulsion boat having a hull, a water jet pump casing within said hull, and an impeller in said pump casing driven by an engine in said hull, said propulsion apparatus comprising:

means in said pump casing defining a converging passage for increasing water flow velocity and having a smaller diameter section within which water jet pressure is reduced due to the increase in velocity;

a hollow impeller shaft defining an exhaust passage within an inner wall of said impeller shaft, said exhaust passage being communicated at a forward end portion of said impeller shaft with an exhaust port of said engine;

means connecting said impeller to said impeller shaft;

an exhaust outlet means communicated with said exhaust passage formed in said impeller shaft and located rearward of said impeller and within said section of said pump casing such as to open and discharge exhaust into a water jet portion of higher velocity and reduced pressure within said section; and a centrifugally operated stop valve for said exhaust outlet operated by said impeller shaft;

said stop valve including:

a valve body having a smaller-diameter portion which is fitted to an inner peripheral surface of said impeller shaft such as to be slidable in an axial direction of said impeller shaft;

a plurality of outlet grooves provided on an outer peripheral surface of said smaller-diameter portion such as to be parallel to an axis of said impeller shaft;

a pair of flyweights which can be opened radially outward by centrifugal force as said impeller shaft is rotated:

a mechanism which transmits the motions of said flyweights to said valve body, thereby moving said smaller-diameter portion rearwardly inside said impeller shaft; and a spring acting in such a manner that each of said pair of flyweights is closed radially inward.

* * * * *